US008080068B2

(12) United States Patent
Iguchi et al.

(10) Patent No.: US 8,080,068 B2
(45) Date of Patent: Dec. 20, 2011

(54) LIGHT OIL COMPOSITIONS

(75) Inventors: Yasutoshi Iguchi, Yokohama (JP); Hideaki Sugano, Yokohama (JP); Osamu Tamura, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 322 days.

(21) Appl. No.: 12/293,310

(22) PCT Filed: Mar. 7, 2007

(86) PCT No.: PCT/JP2007/054455
§ 371 (c)(1),
(2), (4) Date: Sep. 17, 2008

(87) PCT Pub. No.: WO2007/113977

PCT Pub. Date: Oct. 11, 2007

(65) Prior Publication Data

US 2009/0101541 A1 Apr. 23, 2009

(30) Foreign Application Priority Data

Mar. 31, 2006 (JP) ..... 2006-097347
Mar. 31, 2006 (JP) ..... 2006-097515

(51) Int. Cl.
*C10L 1/08* (2006.01)

(52) U.S. Cl. ..... 44/300; 585/14; 208/15

(58) Field of Classification Search ..... 44/300; 585/14; 208/15
See application file for complete search history.

(56) References Cited

U.S. PATENT DOCUMENTS 6,607,568 B2 * 8/2003 Wittenbrink et al. ..... 44/451
(Continued)

FOREIGN PATENT DOCUMENTS

JP 2004-292813 10/2004
(Continued)

OTHER PUBLICATIONS

M. Kobayashi et al., "Properties and Molecular Structures of Fuel Fractions Obtained from Hydrocracking/isomerization of Fischer-Tropsch Waxes," Journal of the Japan Petroleum Institute, vol. 49, No. 4, pp. 194-201 (2006).

(Continued)

*Primary Examiner* — Ellen McAvoy
(74) *Attorney, Agent, or Firm* — Finnegan, Henderson, Farabow, Garrett & Dunner, LLP

(57) ABSTRACT

The invention provides a gas oil composition having a C10-24 paraffin composition that satisfies the condition represented by inequality (1-1) below, a slow-cooling cloud point of no higher than −6.0° C. and a pour point of no higher than −7.5° C. The invention further provides a gas oil composition having a C10-24 paraffin composition that satisfies the condition represented by inequality (1-2) below, a distillate volume at a distillation temperature of 250° C. (E250) of 5-45% and a slow-cooling cloud point of higher than −6.0° C. In inequalities (1-1) and (1-2), n is the carbon number of the paraffin and f(n) is the paraffin composition parameter for the carbon number of n represented by formula (2) below. In formula (2), n represents an integer of 10-24, and a, b and c respectively represent the proportion (in terms of molar value) of normal paraffins with carbon number of n, of isoparaffins with carbon number of n and one branch and of isoparaffins with carbon number of n and two or more branches, with respect to the total amount of paraffins with carbon number of n.

[Mathematical Formula 1]

$$340.0 \le \sum_{n=10}^{24} f(n) \le 400.0 \quad (1\text{-}1)$$

[Mathematical Formula 2]

$$f(n) = 27.45 - 3.55(b/a) - 0.65(c/a) \quad (2)$$

[Mathematical Formula 3]

$$370.0 \le \sum_{n=10}^{24} f(n) \le 430.0 \quad (1\text{-}2)$$

4 Claims, 2 Drawing Sheets

U.S. PATENT DOCUMENTS

| | | | | |
|---|---|---|---|---|
| 6,656,343 | B2 * | 12/2003 | Dancuart | 208/58 |
| 7,294,253 | B2 * | 11/2007 | DeHaan et al. | 208/58 |
| 7,345,211 | B2 * | 3/2008 | Espinoza et al. | 585/14 |
| 7,354,462 | B2 * | 4/2008 | O'Rear | 44/300 |
| 2006/0016722 | A1 * | 1/2006 | Espinoza et al. | 208/14 |
| 2006/0037233 | A1 * | 2/2006 | Guenther et al. | 44/300 |
| 2006/0201850 | A1 * | 9/2006 | DeHaan et al. | 208/15 |
| 2009/0165362 | A1 * | 7/2009 | Iguchi et al. | 44/300 |

FOREIGN PATENT DOCUMENTS

| | | |
|---|---|---|
| JP | 2005-529213 | 9/2005 |
| WO | WO 01/12757 | 2/2001 |
| WO | WO 2004/101715 | 11/2004 |
| WO | WO 2005/035695 | 4/2005 |

OTHER PUBLICATIONS

European Search Report dated Apr. 29, 2011.

Ibrahim, Hassan Al-Haj, et al., "Optimal Conditions for the Hydrodewaxing of Gas Oil to Produce Premium Diesel Fuel," *Arabian J. Sci & Eng'ring*, vol. 28, No. 1B, Apr. 1, 2003, pp. 3-21.

* cited by examiner

LIGHT OIL COMPOSITIONS

TECHNICAL FIELD

The present invention relates to gas oil compositions.

BACKGROUND ART

Conventionally known gas oil stocks include those manufactured by hydrorefining treatment or hydrodesulfurization treatment of straight-run gas oil obtained from atmospheric distillation of crude oil and straight-run kerosene obtained from atmospheric distillation of crude oil. Such gas oil stocks contain additives such as cetane number improvers and purification agents, which are used as necessary.

Incidentally, purification of diesel engine exhaust gas has been a goal in recent years from the viewpoint of improving the atmospheric environment and reducing environmental load. It has been attempted to achieve this goal by developing gas oil stocks that can reduce contaminants in diesel exhaust gas. For example, Patent document 1 below teaches that diesel particulate emission can be reduced by using a compression ignition engine fuel wherein the sulfur and aromatic compound contents and the ratio of isoparaffins and normal paraffins satisfy specific conditions.

[Patent document 1] Japanese Patent Application Laid-Open No. 2005-529213

DISCLOSURE OF THE INVENTION

Problems to be Solved by the Invention

Even such conventional gas oils, however, cannot be considered to have sufficiently practical characteristics.

In terms of fuel efficiency performance, for example, the ignitability tends to be reduced especially during winter season or in cold districts. In the case of conventional gas oils, the cold flow properties tend to be insufficient and the running performance including the cold startability is impaired with the reduced ignitability mentioned above.

Methods for improving the ignition point and cold flow properties may result in a lighter gas oil. Lightening of gas oil is also effective from the standpoint of improving the durability of rubber members. However, simple lightening of gas oils can impair the essential quality as a diesel fuel, including the fuel efficiency and output for engine performance.

It is an object of the present invention, which has been accomplished in light of the circumstances described above, to provide a gas oil composition with excellent ignitability and cold flow properties, which can be suitably used during winter season and in cold districts. It is another object of the invention to provide a gas oil composition which maintains adequate essential quality as a diesel fuel while exhibiting improved ignitability and cold flow properties.

Means for Solving the Problems

With the aim of achieving the objects stated above, the present inventors first analyzed gas oil compositions using Gas Chromatography with Time of Flight Mass Spectrometry (hereinafter abbreviated as GC-TOFMS), and examined the effects of the compositions on ignitability and cold flow properties. As a result it was found that the ignitability and cold flow properties of a gas oil composition can be drastically improved by establishing that a specific condition is satisfied for the paraffin composition within a specified range of carbon numbers and that the slow-cooling cloud point and pour point each satisfy specific conditions, and the invention has been completed upon this finding.

That is, the present invention provides a gas oil composition characterized by having a C10-24 paraffin composition that satisfies the condition represented by the following inequality (1-1), a slow-cooling cloud point of no higher than −6.0° C. and a pour point of no higher than −7.5° C. (hereinafter referred to "first gas oil composition" for convenience).

[Mathematical Formula 1]

$$340.0 \leq \sum_{n=10}^{24} f(n) \leq 400.0 \quad (1\text{-}1)$$

[wherein n represents the carbon number of the paraffin, and f(n) represents the paraffin composition parameter for the carbon number of n represented by the following formula (2):

[Mathematical Formula 2]

$$f(n)=27.45-3.55(b/a)-0.65(c/a) \quad (2)$$

(where n represents an integer of 10-24 and a, b and c respectively represent the proportion (in terms of molar value) of normal paraffins with carbon number of n, of isoparaffins with carbon number n and one branch and of isoparaffins with carbon number n and two or more branches, with respect to the total amount of paraffins with carbon number n)]

By thus establishing the paraffin composition parameter f(n) obtained based on the proportion of normal paraffins, isoparaffins with one branch and isoparaffins with two or more branches having the same carbon number, and specifying that the total of f(n) for C10-24 (the middle term of inequality (1-1) above) is in the range of 340.0-400.0, that the slow-cooling cloud point is no higher than −6.0° C. and the pour point is no higher than −7.5° C., it is possible to drastically improve both the ignitability and cold flow properties, thereby providing a gas oil composition that can be suitably used in winter season or in cold districts.

The terms (b/a) and (c/a) in formula (2), i.e. the molar ratios of isoparaffins with one branch and isoparaffins with two or more branches with respect to normal paraffins for a given carbon number, can be determined by GC-TOFMS, as explained above. In GC-TOFMS, first the constituent components of the sample are separated by gas chromatography, and the separated components are ionized. Next, mass separation of the ions is accomplished, utilizing the fact that the flight speed when applying a fixed acceleration voltage to an ion differs depending on the ion mass, and mass spectra are obtained based on the differences in arrival times to the ion detector. The ionization method in GC-TOFMS is preferably FI ionization, since this can inhibit production of fragment ions and further improve measurement precision for the paraffin composition. The measuring apparatus and measuring conditions according to the invention are as follows.

(GC zone)

Apparatus: HP6890 Series GC System & Injector by HEWLETT PACKARD

Column: Agilent HP-5 (30 m×0.32 mmϕ, 0.25 μm-film)

Carrier gas: He, 1.4 mL/min (constant flow rate)

Inlet temperature: 320° C.

Injection mode: Split (split ratio=1:100)
Oven temperature: Holding at 50° C. for 5 minutes, temperature increase at 5° C./min, holding at 320° C. for 6 minutes.
Injection volume: 1 μL
(TOFMS Zone)
Apparatus: JMS-T100GC by JEOL Corp.
Counter electrode voltage: 10.0 kV
Ionization method: FI+ (field ionization)
GC interface temperature: 250° C.
Measuring mass range: 35-500

By calculating the ratios between the total intensity of isoparaffins with one branch and the total intensity of isoparaffins with two or more branches with respect to the total intensity of normal paraffins for each component having the same carbon number, based on the aforementioned measurement data, it is possible to obtain the molar ratios of isoparaffins with one branch and isoparaffins with two or more branches with respect to normal paraffins. The molar ratios may also be directly determined from the mass spectra, but alternatively a graph showing the correlation between retention time and intensity in gas chromatography for each component having the same carbon number may be drawn based on the mass spectrum data, and the molar ratio determined as the ratio of peak areas for the components in the graph.

FIG. 1 is a graph showing an example of correlation between retention time and intensity in gas chromatography for components having the same carbon number. In FIG. 1, the peaks for regions A, B and C are the peaks corresponding to normal paraffins, isoparaffins with only one branch and isoparaffins with two or more branches, respectively. The molar ratio (b/a) of isoparaffins with one branch with respect to normal paraffins as defined according to the invention is determined as the ratio ($S_B/S_A$) of the peak area $S_B$ of region B with respect to the peak area $S_A$ of region A. Also, the molar ratio (c/a) of isoparaffins with two or more branches with respect to normal paraffins is determined as the ratio ($S_c/S_A$) of the peak area $S_c$ of region C with respect to the peak area $S_A$ of region A.

Conventional development of gas oil has dealt merely with the ratio of normal paraffins and isoparaffins as described in Patent document 1 cited above, whereas the composition is almost never examined in terms of the number of branches in the isoparaffins. Considering the technical level of the prior art, the first gas oil composition described above has been accomplished for the first time based on the knowledge of the present inventors that the paraffin composition parameter f(n), based on the molar ratios of isoparaffins with one branch and isoparaffins with two or more branches with respect to normal paraffins, is suitable as an index of the ignitability and cold flow properties of the gas oil, and that GC-TOFMS is useful as the method for determining f(n), and moreover, the aforementioned effect of the invention may be said to be a highly unexpected effect.

The first gas oil composition also preferably has a cetane number of 65 or higher, a sulfur content of no greater than 10 ppm by mass, an aromatic content of no greater than 1% by mass, a naphthene content of no greater than 5% by mass and a cold filter plugging point of no higher than −5° C.

The invention also provides a gas oil composition characterized by having a C10-24 paraffin composition that satisfies the condition represented by the following inequality (1-2), a distillate volume at a distillation temperature of 250° C. (E250) of 5-45% and a slow-cooling cloud point of higher than −6.0° C. (hereinafter referred to as "second gas oil composition" for convenience).

[Mathematical Formula 3]

$$370.0 \le \sum_{n=10}^{24} f(n) \le 430.0 \tag{1-2}$$

[wherein n represents the carbon number of the paraffin, and f(n) represents the paraffin composition parameter for the carbon number of n represented by the following formula (2):
[Mathematical Formula 4]

$$f(n)=27.45-3.55(b/a)-0.65(c/a) \tag{2}$$

(where n represents an integer of 10-24 and a, b and c respectively represent the proportion (in terms of molar value) of normal paraffins with carbon number n, of isoparaffins with carbon number of n and one branch and of isoparaffins with carbon number of n and two or more branches, with respect to the total amount of paraffins with carbon number of n)]

By thus establishing the paraffin composition parameter f(n) obtained based on the proportion of normal paraffins, isoparaffins with one branch and isoparaffins with two or more branches having the same carbon number, and specifying that the total of f(n) for C10-24 (the middle term of inequality (1-1) above) is in the range of 370.0-430.0 and that E250 and the slow-cooling cloud point satisfy the respective conditions specified above, it is possible to provide a gas oil composition which sufficiently maintains the essential quality as a diesel fuel while exhibiting improved ignitability and cold flow properties. The aforementioned second gas oil composition having such excellent properties is particularly suitable as a summer season diesel fuel.

The method of measuring the molar ratio of isoparaffins with two or more branches to isoparaffins with only one branch for each carbon number is the same as for the first gas oil composition described above, and will not be explained again here.

The term "E250" according to the invention means the distillate volume at a distillation temperature of 250° C., calculated from a distillation curve obtained by the method of JIS K 2254, "Petroleum Products—Distillation Test Methods—Ordinary Pressure Method".

The second gas oil composition also preferably has a cetane number of 65 or higher, a sulfur content of no greater than 10 ppm by mass, an aromatic content of no greater than 1% by mass, a naphthene content of no greater than 5% by mass and a cold filter plugging point of no higher than −5° C.

EFFECT OF THE INVENTION

According to the invention there is provided a gas oil composition with excellent ignitability and cold flow properties, which is suitable for use during the winter season and in cold districts. According to the invention there is further provided a gas oil composition which maintains adequate essential quality as a diesel fuel while exhibiting improved ignitability and cold flow properties.

BEST MODE FOR CARRYING OUT THE INVENTION

Figure 1:
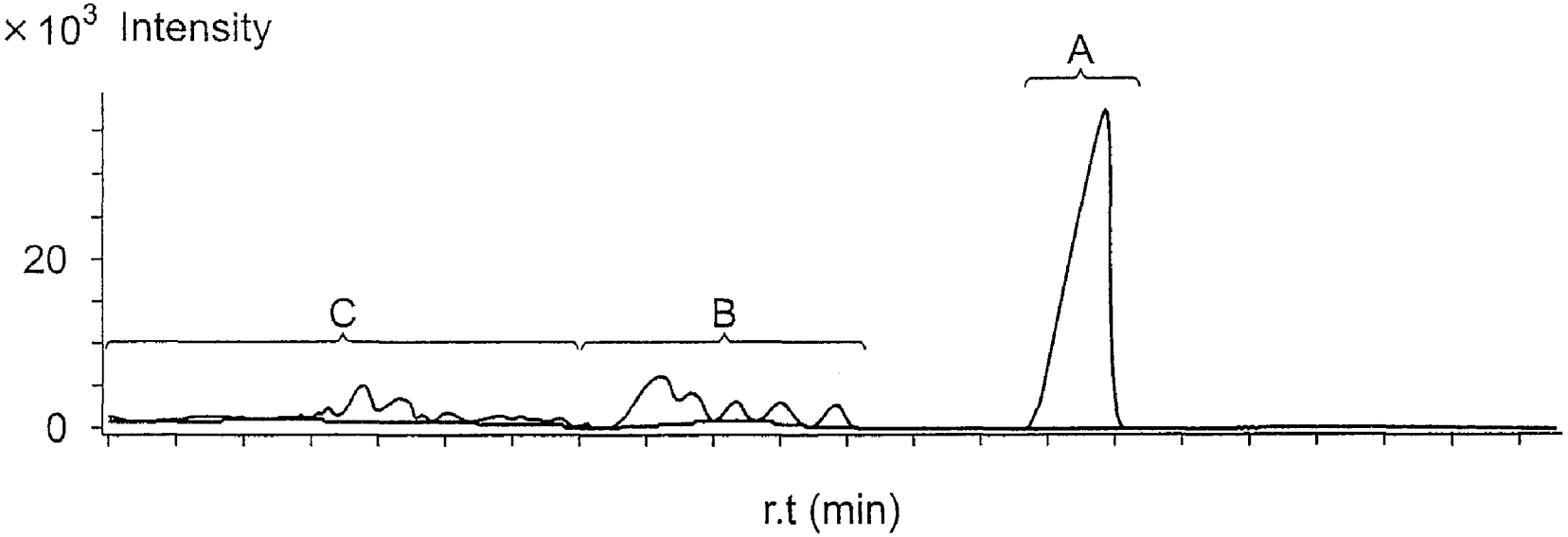
FIG. 1 is a graph obtained by GC-TOFMS, showing an example of correlation between retention time and intensity in gas chromatography for components having the same carbon number.

Preferred embodiments of the invention will now be described in detail.

First Embodiment

The gas oil composition of the first embodiment of the invention is characterized by satisfying the following conditions (A-1), (B-1) and (C-1).

(A-1) The composition of C10-24 paraffins satisfies the condition represented by the following inequality (1-1).

[Mathematical Formula 5]

$$340.0 \leq \sum_{n=10}^{24} f(n) \leq 400.0 \quad (1\text{-}1)$$

[wherein n represents the carbon number of the paraffin, and f(n) represents the paraffin composition parameter for the carbon number of n represented by the following formula (2):

[Mathematical Formula 6]

$$f(n)=27.45-3.55(b/a)-0.65(c/a) \quad (2)$$

(where n represents an integer of 10-24 and a, b and c respectively represent the proportion (in terms of molar value) of normal paraffins with carbon number of n, of isoparaffins with carbon number of n and one branch and of isoparaffins with carbon number n and two or more branches, with respect to the total amount of paraffins with carbon number of n)]

(B-1) The slow-cooling cloud point is no higher than −6.0° C.

(C-1) The pour point is no higher than −7.5° C.

As regards condition (A-1) above, the total of f(n) in the range of C10C-24 (the middle term of inequality (1-1) above) is 340.0-400.0 as mentioned above, but it is preferably 360.0-390.0, more preferably 370.0-390.0 and even more preferably 375.0-388.0. If the total of f(n) in the range of C10-24 is less than 340.0, the volume heat release will be lower, thereby significantly reducing the fuel efficiency per volume, and if it is greater than 400.0 the viscosity will increase, making it impossible to achieve satisfactory injection control.

There are no particular restrictions on the aromatic content of the gas oil composition of the first embodiment, but from the viewpoint of inhibiting production of PM and the like, it is preferably no greater than 15% by volume, more preferably no greater than 10% by volume, even more preferably no greater than 5% by volume and most preferably no greater than 1% by volume, based on the total weight of the composition. "Aromatic content" for the purpose of the invention means the volume percentage (% by volume) of the aromatic content as measured according to Journal of The Japan Petroleum Institute, JPI-5S-49-97, "Hydrocarbon Type Test Methods—High Performance Liquid Chromatography Method", published by The Japan Petroleum Institute.

There are also no particular restrictions on the naphthene content of the gas oil composition of the first embodiment, but from the viewpoint of inhibiting production of PM and the like, it is preferably no greater than 50% by volume, more preferably no greater than 30% by volume, even more preferably no greater than 15% by volume and most preferably no greater than 10% by volume, based on the total weight of the composition. "Naphthene content" for the purpose of the invention means the weight percentage of the naphthene content as measured according to ASTM D2425, "Standard Test Method for Hydrocarbon Types in Middle Distillates by Mass Spectrometry".

There are, furthermore, no particular restrictions on the sulfur content of the gas oil composition of the first embodiment, but it is preferably no greater than 10 ppm by mass, more preferably no greater than 5 ppm by mass, more preferably no greater than 3 ppm by mass and most preferably no greater than 1 ppm by mass based on the total weight of the composition, since this can satisfactorily maintain the purification performance of an exhaust gas post-treatment device in a diesel automobile. "Sulfur content" for the purpose of the invention means the value measured according to JIS K 2541, "Sulfur Content Test Method".

As regards condition (B-1) above, the slow-cooling cloud point of the gas oil composition according to the first embodiment is no higher than −6.0° C. as mentioned above, but it is preferably no higher than −7.0° C., more preferably no higher than −7.5° C. and even more preferably no higher than −8.0° C. A slow-cooling cloud point of −7.0° C. or below will facilitate dissolution of wax that has adhered onto the filter of the fuel injector of a diesel automobile. The "slow-cooling cloud point" according to the invention means the value measured in the manner described below. Specifically, a sample is placed in a sample container with an aluminum bottom surface to a thickness of 1.5 mm, and gas is irradiated from a height of 3 mm from the bottom of the container. It is then slowly cooled at a rate of 0.5° C./min from a temperature at least 10° C. higher than the aforementioned cloud point, and the temperature at which the reflected gas quantity is no more than ⅞ of the irradiated gas (the slow-cooling cloud point) is detected in units of 0.1° C. The "cloud point" means the cloud point measured based on JIS K 2269, "Crude Oil and Petroleum Product Pour Point and Petroleum Product Cloud Point Test Methods". The cloud point of the gas oil composition of the first embodiment is not particularly restricted, but is preferably no higher than 0.0° C., more preferably no higher than −2.0° C., even more preferably no higher than −5.0° C. and most preferably no higher than −8.0° C. A cloud point of 0° C. or below will tend to facilitate dissolution of wax that has adhered onto the filter of the fuel injector of a diesel automobile.

As regards condition (C-1) above, the pour point of the gas oil composition according to the first embodiment is no higher than −7.5° C. as mentioned above, but it is preferably no higher than −10° C., more preferably no higher than −15° C. and even more preferably no higher than −20° C. A pour point of no higher than −7.5° C. can ensure sufficient fluidity in the fuel line of a diesel automobile. The "pour point" according to the invention means the pour point measured based on JIS K 2269, "Crude Oil and Petroleum Product Pour Point and Petroleum Product Cloud Point Test Methods".

The stock of the gas oil composition according to the first embodiment is not particularly restricted so long as the gas oil composition satisfies the aforementioned conditions (A-1), (B-1) and (C-1), and any from among petroleum gas oil stocks, petroleum kerosene stocks, synthetic gas oil stocks and synthetic kerosene stocks may be used alone, or in combinations of two or more. When two or more stocks are used in combination, it is not necessary for each of the stocks alone to satisfy the conditions (A-1), (B-1) and (C-1), as it is sufficient if the blended gas oil composition satisfies the conditions (A-1), (B-1) and (C-1).

As specific examples of petroleum gas oil stocks to be used for the invention there may be mentioned straight-run gas oil obtained from apparatuses for atmospheric distillation of crude oil; vacuum gas oil from vacuum distillation of straight-run heavy oil or residue oil obtained from atmospheric distillation apparatuses; hydrorefined gas oil obtained by hydrorefining of straight-run gas oil or vacuum gas oil; hydrodesulfurized gas oil obtained by hydrodesulfurization of straight-run gas oil or vacuum gas oil in one or more stages under more severe conditions than ordinary hydrorefining; and hydrocracked gas oil obtained by hydrocracking of the different types of gas oil stocks mentioned above.

As specific examples of petroleum kerosene stocks there may be mentioned straight-run kerosene obtained from apparatuses for atmospheric distillation of crude oil; vacuum kerosene from vacuum distillation of straight-run heavy oil or residue oil obtained from atmospheric distillation apparatuses; hydrorefined kerosene obtained by hydrorefining of straight-run kerosene or vacuum kerosene; hydrodesulfurized kerosene obtained by hydrodesulfurization of straight-run kerosene or vacuum kerosene in one or more stages under more severe conditions than ordinary hydrorefining; and hydrocracked kerosene obtained by hydrocracking of the different types of kerosene stocks mentioned above.

According to the invention, the treatment conditions for manufacturing the petroleum stocks when using a petroleum gas oil atock or petroleum kerosene stock may be selected as appropriate. The hydrogen partial pressure for hydrodesulfurization, for example, is preferably at least 1 MPa, more preferably at least 3 MPa and most preferably at least 5 MPa. There is no particular restriction on the upper limit for the hydrogen partial pressure, but it is preferably no greater than 10 MPa from the viewpoint of pressure durability of the reactor. The reaction temperature for hydrodesulfurization is preferably at least 300° C., more preferably at least 320° C. and most preferably at least 340° C. There is no particular restriction on the upper limit for the reaction temperature, but it is preferably no higher than 400° C. from the viewpoint of heat resistance of the reactor. The liquid space velocity for hydrodesulfurization is preferably no greater than 6 $h^{-1}$, more preferably no greater than 4 $h^{-1}$ and most preferably no greater than 2 $h^{-1}$. There is no particular restriction on the lower limit for the liquid space velocity, but it is preferably at least 0.1 $h^{-1}$ from the viewpoint of drift current. The catalyst used for hydrodesulfurization is not particularly restricted, but there may be mentioned combinations of 2-3 different metals from among Ni, Co, Mo, W, Pd and Pt. Specifically, Co—Mo, Ni—Mo, Ni—Co—Mo and Ni—W catalysts are preferred, among which Co—Mo and Ni—Mo catalysts are more preferred from the standpoint of general versatility.

The term "synthetic gas oil stock" refers to a gas oil stock obtained by chemical synthesis using natural gas, asphalt or coal as the starting material. Chemical synthesis methods include indirect liquefaction and direct liquefaction, and Fischer-Tropsch synthesis may be mentioned as a typical synthesis method; however, the synthetic gas oil stock used for the invention is not limited to one produced by these methods. Most synthetic gas oil stocks are composed mainly of saturated hydrocarbons, and specifically they are composed of normal paraffins, isoparaffins and naphthenes. In other words, synthetic gas oil stocks generally contain almost no aromatic components. Thus, a synthetic gas oil stock is preferably used when the intent is to reduce the aromatic content of the gas oil composition.

The term "synthetic kerosene stock" refers to a kerosene stock obtained by chemical synthesis using natural gas, asphalt or coal as the starting material. Chemical synthesis methods include indirect liquefaction and direct liquefaction, and Fischer-Tropsch synthesis may be mentioned as a typical synthesis method; however, the synthetic kerosene stock used for the invention is not limited to one produced by these methods. Most synthetic kerosene stocks are composed mainly of saturated hydrocarbons, and specifically they are composed of normal paraffins, isoparaffins and naphthenes. In other words, synthetic kerosene stocks generally contain almost no aromatic components. Thus, a synthetic kerosene stock is preferably used when the intent is to reduce the aromatic content of the gas oil composition.

The gas oil composition of the first embodiment may contain one or more of the aforementioned petroleum stocks and/or synthetic stocks, but synthetic gas oil stocks and/or synthetic kerosene stocks are preferred among them as essential components from the viewpoint of minimizing increase in the environmental load due to the sulfur and aromatic contents. The total content of synthetic gas oil stocks and/or synthetic kerosene stocks is preferably at least 20% by volume, more preferably at least 30% by volume, even more preferably at least 40% by volume and most preferably at least 50% by volume, based on the total weight of the composition.

The gas oil composition of the first embodiment may be composed entirely of the aforementioned gas oil stock and/or kerosene stock, but if necessary it may further contain a cold flow improver. As cold flow improvers there may be mentioned, specifically, cold flow improvers including linear compounds such as ethylene-unsaturated ester copolymers, typically ethylene-vinyl acetate copolymer, or alkenylsuccinic acid amides, polyethylene glycol dibehenic acid ester and the like, and tandem polymers composed of alkyl fumarate or alkyl itaconate-unsaturated ester copolymers, or cold flow improvers containing polar nitrogen compounds composed of reaction products of acids such as phthalic acid, succinic acid, ethylenediaminetetraacetic acid or nitriloacetic acid or their acid anhydrides with hydrocarbyl-substituted amines or the like, and any of these compounds may be used alone or in combinations of two or more. Among these there are preferred ethylene-vinyl acetate copolymer additives and cold flow improvers containing polar nitrogen compounds from the viewpoint of general versatility, while more preferred are cold flow improvers containing polar nitrogen compounds, from the viewpoint of promoting refining of the wax crystals and preventing flocculated sedimentation of the wax.

The cold flow improver content is preferably 50-500 mg/L and more preferably 100-300 mg/L, based on the total weight of the composition. If the cold flow improver content is below the lower limit, the effect of addition toward improving the cold flow property will tend to be insufficient. A cold flow improver content exceeding the upper limit will not provide any further improving effect on the cold flow property commensurate with the increased content.

The gas oil composition of the first embodiment may further contain a lubricity improver. As lubricity improvers there may be used one or more esteric, carboxylic, alcoholic, phenolic, amine-based or other types of lubricity improvers. Preferred for use among these from the standpoint of general versatility are esteric and carboxylic lubricity improvers. An esteric lubricity improver is preferred from the viewpoint of avoiding saturation of the effect of addition with respect to the addition concentration and further lowering the HFRR WS1.4 value, while a carboxylic lubricity improver is preferred from the viewpoint of high initial responsiveness of the effect of addition with respect to the addition concentration, allowing the lubricity improver to be reduced in amount.

As examples of esteric lubricity improvers there may be mentioned glycerin carboxylic acid esters, and specifically glycerin esters of linoleic acid, oleic acid, salicylic acid, palmitic acid, myristic acid and hexadecenoic acid, any one or more of which may be used as appropriate.

The lubricity improver content is preferably 25-500 mg/L, more preferably 25-300 mg/L and even more preferably 25-200 mg/L based on the total weight of the composition. If the lubricity improver content is below the lower limit, the effect of addition toward improving the lubricity will tend to be insufficient. A lubricity improver content exceeding the upper limit will not provide any further improving effect on the cold flow property commensurate with the increased content.

The gas oil composition of the first embodiment may further contain other additives in addition to the aforementioned cold flow improver and lubricity improver. As such additives there may be mentioned purification agents such as alkenylsuccinic acid derivatives and carboxylic acid amine salts, phenolic, amine-based and other types of antioxidants, metal inactivating agents such as salicylidene derivatives, deicing agents such as polyglycol ethers, corrosion inhibitors such as aliphatic amines and alkenylsuccinic acid esters, antistatic agents such as anionic, cationic and amphoteric surfactants, coloring agents such as azo dyes, and silicon-based and other types of antifoaming agents. Such other additives may be used alone or in combinations of two or more. The amounts of addition may be selected as appropriate, but the total amount of such additives is preferably no greater than, for example, 0.5% by mass and more preferably no greater than 0.2% by mass with respect to the gas oil composition. The total amount of addition referred to here is the amount of additives added as active components.

The gas oil composition of the first embodiment also preferably satisfies the following conditions in addition to the aforementioned conditions (A-1), (B-1) and (C-1), from the viewpoint of further improving performance.

From the viewpoint of ignitability, the cetane index of the gas oil composition of the first embodiment is preferably at least 65, more preferably at least 70, even more preferably at least 73 and most preferably at least 75.

Also, from the viewpoint of ignitability, the cetane number of the gas oil composition of the first embodiment is preferably at least 65, more preferably at least 70, even more preferably at least 73 and most preferably at least 75.

The "cetane index" and "cetane number" according to the invention are the values measured according to JIS K 2280, "Petroleum Products—Fuel Oils—Octane Number and Cetane Number Test Methods and Cetane Index Calculation Method".

The cold filter plugging point of the gas oil composition of the first embodiment is preferably no higher than −5° C., more preferably no higher than −6° C., even more preferably no higher than −7° C. and most preferably no higher than −8° C., since this will help prevent clogging of the filter installed in the fuel injector of a diesel automobile. The "cold filter plugging point" according to the invention is the value measured according to JIS K 2288, "Petroleum Products—Gas Oils—Cold Filter Plugging Point Test Methods".

The 30° C. kinematic viscosity of the gas oil composition of the first embodiment is preferably at least 1.7 $mm^2/s$, more preferably at least 2.0 $mm^2/s$, even more preferably at least 2.3 $mm^2/s$ and most preferably at least 2.5 $mm^2/s$, and preferably no greater than 5.0 $mm^2/s$, more preferably no greater than 4.7 $mm^2/s$, even more preferably no greater than 4.5 $mm^2/s$ and most preferably no greater than 4.3 $mm^2/s$. A 30° C. kinematic viscosity which is below the aforementioned lower limit may lead to start-up failure or unstable rotation of the engine during idling, when using the oil in a diesel automobile at a relatively high temperature. On the other hand, a 30° C. kinematic viscosity which is above the aforementioned upper limit will tend to increase the volume of black smoke in the exhaust gas. The "30° C. kinematic viscosity" according to the invention is the value measured based on JIS K 2283, "Crude Oil and Petroleum Products—Kinematic Viscosity Test Methods and Viscosity Index Calculation Method".

From the standpoint of safety during handling, the flash point of the gas oil composition of the first embodiment is preferably at least 45° C., more preferably at least 50° C., even more preferably at least 53° C. and most preferably at least 55° C. The "flash point" according to the invention is the value measured based on JIS K 2265, "Crude Oil and Petroleum Products—Flash Point Test Methods".

In regard to the distillation properties of the gas oil composition of the first embodiment, the initial boiling point (IBP) is preferably at least 140° C., more preferably at least 145° C., even more preferably at least 150° C. and most preferably at least 155° C., and preferably no higher than 195° C., more preferably no higher than 190° C., even more preferably no higher than 185° C. and most preferably no higher than 180° C. If the IBP is below the aforementioned lower limit, the light fraction will partially gasify and the unburned hydrocarbon content of the exhaust gas will tend to increase with a wider misting range in the engine of a diesel automobile, thus tending to result in a reduced hot startability and lower rotational stability of the engine during idling. On the other hand, if the IBP is above the aforementioned upper limit, the cold startability and running performance in a diesel automobile will tend to be reduced.

The 10% distillation temperature (hereinafter abbreviated as "T10") of the gas oil composition of the first embodiment is preferably 165° C. or higher, more preferably 170° C. or higher, even more preferably 175° C. or higher and most preferably 180° C. or higher, and preferably no higher than 205° C., more preferably no higher than 200° C., even more preferably no higher than 195° C. and most preferably no higher than 190° C. If T10 is below the aforementioned lower limit, the light fraction will partially gasify and the unburned hydrocarbon content of the exhaust gas will tend to increase with a wider misting range in the engine of a diesel automobile, thus tending to result in reduction in the hot startability and rotational stability of the engine during idling. On the other hand, if T10 is above the aforementioned upper limit, the cold startability and running performance in a diesel automobile will tend to be reduced.

The 50% distillation temperature (hereinafter abbreviated as "T50") of the gas oil composition of the first embodiment is preferably 200° C. or higher, more preferably 205° C. or higher, even more preferably 210° C. or higher and most preferably 215° C. or higher, and preferably no higher than 260° C., more preferably no higher than 255° C., even more preferably no higher than 250° C. and most preferably no higher than 245° C. A T50 below the aforementioned lower limit will tend to lower the fuel consumption rate, engine output, hot startability and rotational stability of the engine during idling, when the oil is used in a diesel automobile. On the other hand, a T50 above the aforementioned upper limit will tend to increase the amount of particulate matter (hereinafter, "PM") emitted from the engine in a diesel automobile.

The 90% distillation temperature (hereinafter abbreviated as "T90") of the gas oil composition of the first embodiment is preferably 265° C. or higher, more preferably 270° C. or higher, even more preferably 275° C. or higher and most preferably 280° C. or higher, and preferably no higher than 335° C., more preferably no higher than 330° C., even more preferably no higher than 325° C. and most preferably no higher than 320° C. A T90 below the aforementioned lower limit will tend to lower the fuel consumption rate, hot startability and rotational stability of the engine during idling, when the oil is used in a diesel automobile. Also, the improving effect on the cold filter plugging point by the cold flow improver will tend to be reduced when the gas oil composition contains a cold flow improver. On the other hand, a T90 above the aforementioned upper limit will tend to increase the amount of PM emitted from the engine in a diesel automobile.

The end point (hereinafter abbreviated as "EP") of the gas oil composition of the first embodiment is preferably 310° C. or higher, more preferably 315° C. or higher, even more preferably 320° C. or higher and most preferably 325° C. or higher, and preferably no higher than 355° C., more preferably no higher than 350° C., even more preferably no higher than 345° C. and most preferably no higher than 340° C. An EP below the aforementioned lower limit will tend to lower the fuel consumption rate, hot startability and rotational stability of the engine during idling, when the oil is used in a diesel automobile. Also, the improving effect on the cold filter plugging point by the cold flow improver will tend to be reduced when the gas oil composition contains a cold flow improver. On the other hand, an EP above the aforementioned upper limit will tend to increase the amount of PM emitted from the engine in a diesel automobile.

The terms "IBP", "T10", "T50", "T90" and "EP" used according to the invention are the values measured based on JIS K 2254, "Petroleum Products—Distillation Test Methods—Ordinary Pressure Method".

In regard to the lubricity of the gas oil composition of the first embodiment, the HFRR WS1.4 value is preferably no greater than 500, more preferably no greater than 460, even more preferably no greater than 420 and most preferably no greater than 400. If the WS1.4 value satisfies this condition, it will be possible to ensure sufficient lubricity in the injection pump of a diesel automobile. The term "HFRR WS1.4 value" according to the invention is an index for judging the lubricity of a gas oil, and it means the value measured based on the Japan Petroleum Institute standard JPI-5S-50-98, "Gas Oils—Lubricity Test Method", published by The Japan Petroleum Institute.

Second Embodiment

The gas oil composition of the second embodiment of the invention is characterized by satisfying the following conditions (A-2), (B-2) and (C-2).

(A-2) The composition of C10-24 paraffins satisfies the condition represented by the following inequality (1-2).

[Mathematical Formula 7]

$$370.0 \leq \sum_{n=10}^{24} f(n) \leq 430.0 \quad (1\text{-}2)$$

[wherein n represents the carbon number of the paraffin, and f(n) represents the paraffin composition parameter for the carbon number of n represented by the following formula (2):

[Mathematical Formula 8]

$$f(n)=27.45-3.55(b/a)-0.65(c/a) \quad (2)$$

(where n represents an integer of 10-24 and a, b and c respectively represent the proportion (in terms of molar value) of normal paraffins with carbon number of n, of isoparaffins with carbon number of n and one branch and of isoparaffins with carbon number of n and two or more branches, with respect to the total amount of paraffins with carbon number of n)]

(B-2) The distillate volume at a distillation temperature of 250° C. (E250) is 5-45%.

(C-2) The slow-cooling cloud point is no higher than −6.0° C.

As regards condition (A-2) above, the total of f(n) in the range of C10-24 (the middle term of inequality (1-2) above) is 370.0-430.0 as mentioned above, but it is preferably 375.0-410.0, more preferably 380.0-400.0 and even more preferably 382.0-390.0. If the total of f(n) in the range of C10-24 is less than 370.0, the volume heat release will be lower, thereby significantly reducing the fuel efficiency per volume, and if it is greater than 430.0 the viscosity will increase, making it impossible to achieve satisfactory injection control.

There are no particular restrictions on the aromatic content of the gas oil composition of the second embodiment, but from the viewpoint of inhibiting production of PM and the like, it is preferably no greater than 15% by volume, more preferably no greater than 10% by volume, even more preferably no greater than 5% by volume and most preferably no greater than 1% by volume, based on the total weight of the composition.

There are also no particular restrictions on the naphthene content of the gas oil composition of the second embodiment, but from the viewpoint of inhibiting production of PM and the like, it is preferably no greater than 30% by volume, more preferably no greater than 20% by volume, even more preferably no greater than 15% by volume and most preferably no greater than 10% by volume, based on the total weight of the composition.

There are, furthermore, no particular restrictions on the sulfur content of the gas oil composition of the second embodiment, but it is preferably no greater than 10 ppm by mass, more preferably no greater than 5 ppm by mass, more preferably no greater than 3 ppm by mass and most preferably no greater than 1 ppm by mass based on the total weight of the composition, since this can satisfactorily maintain the purification performance of an exhaust gas post-treatment device in a diesel automobile.

In regard to condition (B-2), the E250 of the gas oil composition of the second embodiment must be 5-45% as mentioned above, but it is preferably 10-43%, more preferably 15-40% and even more preferably 17-38%. If E250 is less than 5%, the durability for rubber members used in diesel automobiles will be insufficient. If E250 is greater than 45% it will not be possible to maintain the performance including the fuel consumption rate, engine output, hot startability and rotational stability of the engine during idling, when the oil is used in a diesel automobile.

In regard to condition (C-2) above, the slow-cooling cloud point of the gas oil composition of the second embodiment must be higher than −6.0° C. as mentioned above, but it is preferably −5.5° C. or higher, more preferably −5.2° C. or higher and even more preferably −5.0° C. or higher. A slow-cooling cloud point of higher than −6.0° C. will allow the cold filter plugging point to be sufficiently lowered by the cold flow improver. The "slow-cooling cloud point" according to the invention means the value measured in the manner described below. Specifically, a sample is placed in a sample container with an aluminum bottom surface to a thickness of 1.5 mm, and light is irradiated from a height of 3 mm from the bottom of the container. It is then slowly cooled at a rate of 0.5° C./min from a temperature at least 10° C. higher than the aforementioned cloud point, and the temperature at which the reflected light quantity is no more than ⅞ of the irradiated light (the slow-cooling cloud point) is detected in units of 0.1° C.

The stock of the gas oil composition according to the second embodiment is not particularly restricted so long as the gas oil composition satisfies the aforementioned conditions (A-2), (B-2) and (C-2), and any from among petroleum gas oil stocks, petroleum kerosene stocks, synthetic gas oil stocks and synthetic kerosene stocks may be used alone, or in combinations of two or more. When two or more stocks are used in combination, it is not necessary for each of the stocks alone to satisfy the conditions (A-2), (B-2) and (C-2), as it is sufficient if the blended gas oil composition satisfies the conditions (A-2), (B-2) and (C-2).

The petroleum gas oil stock, petroleum kerosene stock, synthetic gas oil stock and synthetic kerosene stock used for the second embodiment are the same as for the first embodiment and will not be explained again here.

The gas oil composition of the second embodiment may contain one or more of the aforementioned petroleum stocks and/or synthetic stocks, but synthetic gas oil stocks and/or synthetic kerosene stocks are preferred among them as essential components from the viewpoint of minimizing increase in the environmental load due to the sulfur and aromatic contents. The total content of synthetic gas oil stocks and/or synthetic kerosene stocks is preferably at least 20% by volume, more preferably at least 30% by volume, even more preferably at least 40% by volume and most preferably at least 50% by volume, based on the total weight of the composition.

The gas oil composition of the second embodiment may be composed only of the aforementioned gas oil stock and/or kerosene stock, but if necessary it may also contain a cold flow improver. As cold flow improvers there may be used the same cold flow improvers mentioned in the explanation of the first embodiment. A single cold flow improver may be used, or a combination of two or more thereof may be used. Preferred cold flow improvers from the standpoint of general versatility are ethylene-vinyl acetate copolymer additives and cold flow improvers containing polar nitrogen compounds, while more preferred are cold flow improvers containing polar nitrogen compounds, from the viewpoint of promoting refining of the wax crystals and preventing flocculated sedimentation of the wax.

The cold flow improver content is preferably 50-500 mg/L and more preferably 100-300 mg/L, based on the total weight of the composition. If the cold flow improver content is below the lower limit, the effect of addition toward improving the cold flow property will tend to be insufficient. A cold flow improver content exceeding the upper limit generally will not provide any further improving effect on the cold flow property commensurate with the increased content.

The gas oil composition of the second embodiment may further contain a lubricity improver. As lubricity improvers there may be used one or more esteric, carboxylic, alcoholic, phenolic or amine-based lubricity improvers which were mentioned as examples in the explanation of the first embodiment. Preferred for use among these from the standpoint of general versatility are esteric and carboxylic lubricity improvers. An esteric lubricity improver is preferred from the viewpoint of avoiding saturation of the effect of addition with respect to the addition concentration and further lowering the HFRR WS1.4 value, while a carboxylic lubricity improver is preferred from the viewpoint of high initial responsiveness of the effect of addition with respect to the addition concentration, allowing the lubricity improver to be reduced in amount.

The lubricity improver content is preferably 25-500 mg/L, more preferably 25-300 mg/L and even more preferably 25-200 mg/L based on the total weight of the composition. If the lubricity improver content is below the lower limit, the effect of addition toward improving the lubricity will tend to be insufficient. A lubricity improver content exceeding the upper limit generally will not provide any further improving effect on the cold flow property commensurate with the increased content.

The gas oil composition of the second embodiment may further contain other additives in addition to the aforementioned cold flow improver and lubricity improver. As such additives there may be mentioned purification agents such as alkenylsuccinic acid derivatives and carboxylic acid amine salts, phenolic, amine-based and other types of antioxidants, metal inactivating agents such as salicylidene derivatives, deicing agents such as polyglycol ethers, corrosion inhibitors such as aliphatic amines and alkenylsuccinic acid esters, antistatic agents such as anionic, cationic and amphoteric surfactants, coloring agents such as azo dyes, and silicon-based and other types of antifoaming agents. Such other additives may be used alone or in combinations of two or more. The amounts of addition may be selected as appropriate, but the total amount of such additives is preferably no greater than, for example, 0.5% by mass and more preferably no greater than 0.2% by mass with respect to the gas oil composition. The total amount of addition referred to here is the amount of additives added as active components.

The gas oil composition of the second embodiment also preferably satisfies the following conditions in addition to the aforementioned conditions (A-2), (B-2) and (C-2), from the viewpoint of further improving performance.

From the viewpoint of ignitability, the cetane index of the gas oil composition of the second embodiment is preferably at least 65, more preferably at least 70, even more preferably at least 75 and most preferably at least 80.

Also, from the viewpoint of ignitability, the cetane number of the gas oil composition of the second embodiment is preferably at least 65, more preferably at least 70, even more preferably at least 75 and most preferably at least 80.

In regard to condition (C-2) above, the pour point of the gas oil composition of the second embodiment is preferably no higher than −2.5° C. and more preferably no higher than −5.0° C. Limiting the pour point to no higher than the aforementioned upper limit can ensure sufficient fluidity in the fuel line of a diesel automobile.

The cold filter plugging point of the gas oil composition of the second embodiment is preferably no higher than −1° C., more preferably no higher than −2° C., even more preferably no higher than −3° C. and most preferably no higher than −4° C., since this will help prevent clogging of the filter installed in the fuel injector of a diesel automobile.

The 30° C. kinematic viscosity of the gas oil composition of the second embodiment is preferably at least 2.0 $mm^2/s$, more preferably at least 2.2 $mm^2/s$, even more preferably at least 2.4 $mm^2/s$ and most preferably at least 2.5 $mm^2/s$, and preferably no greater than 4.2 $mm^2/s$, more preferably no greater than 4.0 $mm^2/s$, even more preferably no greater than 3.9 $mm^2/s$ and most preferably no greater than 3.8 $mm^2/s$. A 30° C. kinematic viscosity which is below the aforementioned lower limit may lead to start-up failure or unstable rotation of the engine during idling, when using the oil in a diesel automobile at a relatively high temperature. On the other hand, a 30° C. kinematic viscosity which is above the aforementioned upper limit will tend to increase the volume of black smoke in the exhaust gas.

The flash point of the gas oil composition of the second embodiment is preferably 60° C. or higher, more preferably 65° C. or higher, even more preferably 70° C. or higher and most preferably 75° C. or higher, from the standpoint of safety during handling.

In regard to the distillation properties of the gas oil composition of the second embodiment, the initial boiling point (IBP) is preferably 155° C. or higher, more preferably 160° C. or higher, even more preferably 165° C. or higher and most preferably 170° C. or higher, and preferably no higher than 225° C., more preferably no higher than 220° C., even more preferably no higher than 215° C. and most preferably no higher than 210° C. If the IBP is below the aforementioned lower limit, the light fraction will partially gasify and the unburned hydrocarbon content of the exhaust gas will tend to increase with a wider misting range in the engine of a diesel automobile, thus tending to result in reduction in the hot startability and rotational stability of the engine during idling. On the other hand, if the IBP is above the aforementioned upper limit, the cold startability and running performance in a diesel automobile will tend to be reduced.

The 10% distillation temperature (T10) of the gas oil composition of the second embodiment is preferably 175° C. or higher, more preferably 180° C. or higher, even more preferably 185° C. or higher and most preferably 190° C. or higher, and preferably no higher than 270° C., more preferably no higher than 265° C., even more preferably no higher than 260° C. and most preferably no higher than 255° C. If T10 is below the aforementioned lower limit, the light fraction will partially gasify and the unburned hydrocarbon content of the exhaust gas will tend to increase with a wider misting range in the engine of a diesel automobile, thus tending to result in reduction in the hot startability and rotational stability of the engine during idling. On the other hand, if T10 is above the aforementioned upper limit, the cold startability and running performance in a diesel automobile will tend to be reduced.

The 50% distillation temperature (T50) of the gas oil composition of the second embodiment is preferably 230° C. or higher, more preferably 235° C. or higher, even more preferably 240° C. or higher and most preferably 245° C. or higher, and preferably no higher than 300° C., more preferably no higher than 295° C., even more preferably no higher than 290° C. and most preferably no higher than 285° C. A T50 below the aforementioned lower limit will tend to lower the fuel consumption rate, engine output, hot startability and rotational stability of the engine during idling, when the oil is used in a diesel automobile. On the other hand, a T50 above the aforementioned upper limit will tend to increase the amount of particulate matter (PM) emitted from the engine in a diesel automobile.

The 90% distillation temperature (T90) of the gas oil composition of the second embodiment is preferably 285° C. or higher, more preferably 290° C. or higher, even more preferably 295° C. or higher and most preferably 300° C. or higher, and preferably no higher than 335° C., more preferably no higher than 330° C., even more preferably no higher than 325° C. and most preferably no higher than 320° C. A T90 below the aforementioned lower limit will tend to lower the fuel consumption rate, hot startability and rotational stability of the engine during idling, when the oil is used in a diesel automobile. Also, the improving effect on the cold filter plugging point by the cold flow improver will tend to be reduced when the gas oil composition contains a cold flow improver. On the other hand, a T90 above the aforementioned upper limit will tend to increase the amount of PM emitted from the engine in a diesel automobile.

The end point (EP) of the gas oil composition of the second embodiment is preferably 305° C. or higher, more preferably 310C or higher, even more preferably 315° C. or higher and most preferably 320° C. or higher, and preferably no higher than 355° C., more preferably no higher than 350° C., even more preferably no higher than 345° C. and most preferably no higher than 340° C. An EP below the aforementioned lower limit will tend to lower the fuel consumption rate, hot startability and rotational stability of the engine during idling, when the oil is used in a diesel automobile. Also, the improving effect on the cold filter plugging point by the cold flow improver will tend to be reduced when the gas oil composition contains a cold flow improver. On the other hand, an EP above the aforementioned upper limit will tend to increase the amount of PM emitted from the engine in a diesel automobile.

In regard to the lubricity of the gas oil composition of the second embodiment, the HFRR WS1.4 value is preferably no greater than 500, more preferably no greater than 460, even more preferably no greater than 420 and most preferably no greater than 400. If the WS1.4 value satisfies this condition, it will be possible to ensure sufficient lubricity in the injection pump of a diesel automobile.

EXAMPLES

The present invention will now be explained in greater detail based on examples and comparative examples, with the understanding that these examples are in no way limitative on the invention.

Examples 1-2, Comparative Examples 1-3

For Examples 1-2 and Comparative Examples 1-3, gas oil compositions were prepared having the compositions and properties listed in Table 1. The gas oil compositions of Examples 1 and 2 were fuels obtained by hydrotreatment of wax and middle fractions obtained from natural gas by Fischer-Tropsch reaction. The gas oil composition of Comparative Example 1 was a fuel from crude oil produced by ordinary hydrorefining. The gas oil composition of Comparative Example 2 was a fuel obtained by hydrotreatment of a wax and middle fraction obtained from natural gas by Fischer-Tropsch reaction, but the degree of hydrotreatment was lower than for the gas oil compositions of Examples 1 and 2. The gas oil composition of Comparative Example 3 was a fuel obtained by further hydrotreatment of a fuel from crude oil produced by ordinary hydrorefining, with further treatment of lowering sulfur content and aromatic content.

The gas oil compositions of Examples 1-2 and Comparative Examples 1-3 were subjected to the following tests.

[Ignitability Test]

In order to confirm the cold ignitability, the cold white smoke was measured using the diesel automobile described below on a chassis dynamometer with controllable environmental temperature.

(Vehicle Specifications)

Engine type: Inter cooler-equipped supercharged serial 4-cylinder diesel

Cylinder capacity: 3 L

Compression ratio: 18.5

Maximum output: 125 kW/3400 rpm

Maximum torque: 350 Nm/2400 rpm

Conformity to regulations: Conformed to 1997 exhaust gas regulations

Mission: 4AT

Exhaust gas post-treatment apparatus: Oxidation catalyst

For a cold actual driving test, first the fuel system of a diesel automobile was flashed with the evaluation fuel (each gas oil composition) at room temperature. The flashing fuel was extracted, the main filter was replaced with a new one, and then a prescribed volume of evaluation fuel was loaded into the fuel tank (½ the volume of the fuel tank of the test vehicle). Next, the environmental temperature was rapidly cooled from room temperature to 5° C., and after holding at 5° C. for 1 hour, it was slowly cooled to −10° C. at a cooling rate of 1° C./h, the temperature was held at −10° C. for 1 hour, and a running test was initiated. Cases in which start-up could not be achieved even by twice repeating 10-second cranking at 30 second intervals were recorded as unmeasurable. When start-up was achieved, a procedure was repeated 5 times in which idling was continued for 30 seconds and followed by full stamping of the accelerator pedal for 5 seconds, and the volume of white smoke that occurred was measured using a transmission measuring device. The average value of 5 measurements was calculated for each gas oil composition and recorded as a relative value with respect to 100 as the average value for Comparative Example 3, to evaluate the ignitability. The results are shown in Table 1.

[Cold Actual Driving Test]

The following two diesel automobiles A and B were used on a chassis dynamometer with controllable environmental temperature, for a cold actual driving test.

(Vehicle a Specifications)

Maximum load: 2 t

Engine type: Serial 4-cylinder diesel

Engine cylinder capacity: 4.3 L

Fuel injection pump: Sequential

Conformity to regulations: Conformed to short-term exhaust gas regulations (base vehicle)

Exhaust gas post-treatment apparatus: PM-reduction apparatus designated by Tokyo Metropolitan Government (conforming to category 4).

Fuel used for PM-reduction apparatus: Low-sulfur gas oil (sulfur content: ≦50 ppm by mass)

(Vehicle B Specifications)

Engine type: Inter cooler-equipped supercharged serial 4-cylinder diesel

Engine cylinder capacity: 3.0 L

Fuel injection system: Common-rail system

Conformity to regulations: Conformed to long-term exhaust gas regulations

Exhaust gas post-treatment apparatus: Oxidation catalyst

For a cold actual driving test, first the fuel system of a diesel automobile was flashed with the evaluation fuel (each gas oil composition) at room temperature. The flashing fuel was extracted, the main filter was replaced with a new one, and then a prescribed volume of evaluation fuel was loaded into the fuel tank (½ the volume of the fuel tank of the test vehicle). Next, the environmental temperature was rapidly cooled from room temperature to 5° C., and after holding at 5° C. for 1 hour, it was slowly cooled to −10° C. at a cooling rate of 1° C./h, the temperature was held at −10° C. for 1 hour, and a running test was initiated. The running test consisted of "engine start-up", "5-minute idling", "acceleration to 50 km/h" and "1 hour running at 50 km/h", and passing or failing of the test was judged based on the operating condition. Specifically, a judgment of satisfactory (S) was assigned when no problems were encountered with engine start-up, idling or acceleration, and running at 50 km/h was maintained throughout the entire running period. A judgment of adequate (A) was assigned in cases where minor problems were encountered but running could be continued, such as when the engine did not start up with the first cranking, or when the vehicle speed slowed temporarily during running but subsequently recovered. A judgment of bad (B) was assigned in cases where running could not be maintained, such as failure to start-up (no start-up even after 5 repetitions of 10-second cranking at 30 second intervals), idling stall or engine stop. The results are shown in Table 1.

[Fuel Efficiency Test]

Figure 2:
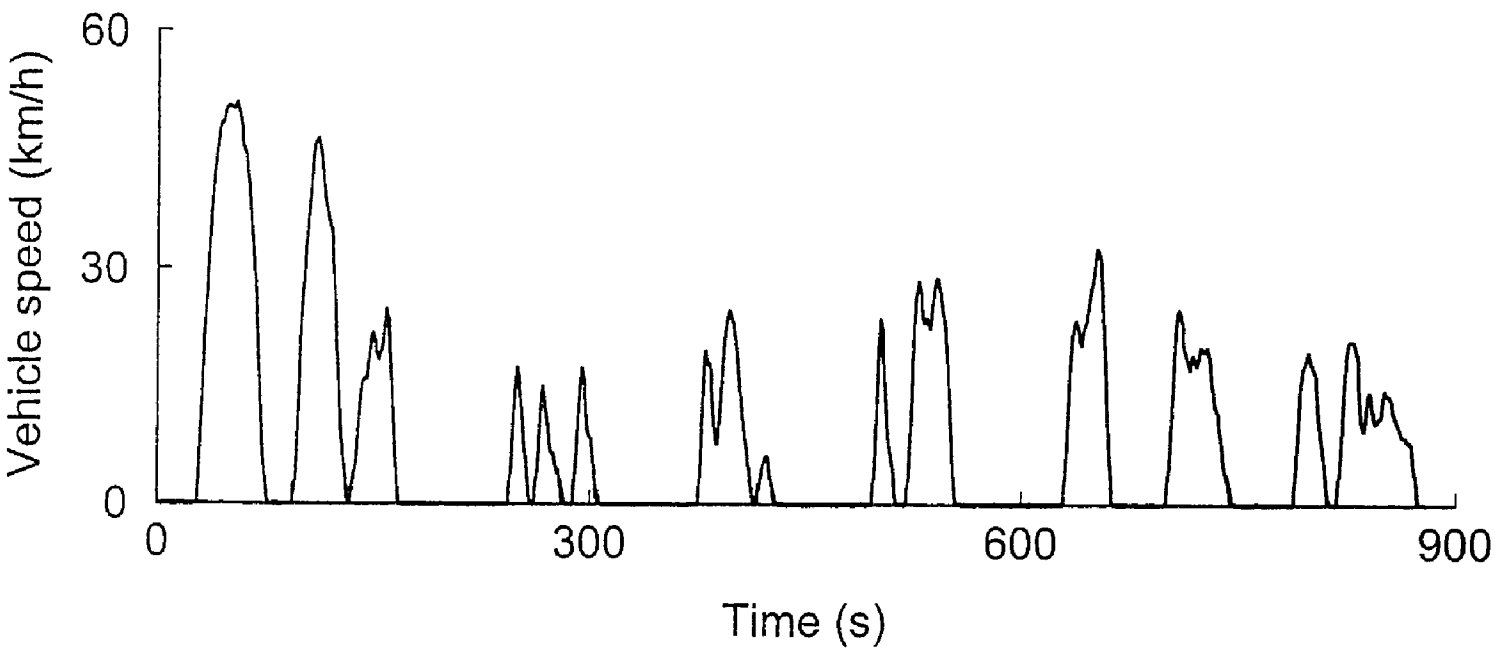
FIG. 2 is a graph showing the operation mode (relationship between time and vehicle speed) for a fuel efficiency test.

The fuel efficiency was measured using the diesel engine-mounted vehicle described below. The test was carried out in transient driving mode to simulate actual running as shown in FIG. 2, and the fuel efficiency was determined with fuel temperature compensation of the volume flow of fuel consumed in the test mode and substitution of the value for the weight, comparing and quantifying each of the results relative to 100 as the result for testing of the fuel of Comparative Example 1.

(Vehicle Specifications)

Engine type: Inter cooler-equipped supercharged serial 4-cylinder diesel

Engine cylinder capacity: 3 L

Compression ratio: 18.5

Maximum output: 125 kW/3400 rpm

Maximum torque: 350 Nm/2400 rpm

Conformity to regulations: Conformed to 1997 exhaust gas regulations

Mission: 4AT

Exhaust gas post-treatment apparatus: Oxidation catalyst

TABLE 1

| | | Example 1 | Example 2 | Comp. Ex. 1 | Comp. Ex. 2 | Comp. Ex. 3 |
|---|---|---|---|---|---|---|
| $\sum_{n=10}^{24} f(n)$ | | 387.3 | 380.1 | 407.4 | 373.7 | 382.2 |
| Sulfur content (ppm by mass) | | <1 | <1 | 5 | <1 | <1 |
| Aromatic content (% by volume) | | <0.1 | <0.1 | 23.5 | <0.1 | <0.1 |
| Naphthene content (% by volume) | | <0.1 | <0.1 | 34.2 | <0.1 | 51.0 |
| Density at 15° C. (kg/m$^3$) | | 769 | 756 | 836 | 786 | 812 |
| Kinematic viscosity at 30° C. (mm$^2$/s) | | 2.6 | 1.7 | 2.9 | 4.7 | 3.5 |
| Distillation properties | 10% distillation temp. (° C.) | 192.3 | 178.3 | 195.5 | 255.5 | 214.0 |
| | 50% distillation temp. (° C.) | 251.2 | 206.3 | 261.0 | 302.5 | 263.0 |
| | 90% distillation temp. (° C.) | 307.5 | 274.0 | 323.0 | 340.0 | 325.5 |
| Cetane number | | 76 | 67 | 53 | 87 | 63 |
| Cetane index | | 81.3 | 71.0 | 49.7 | 93.4 | 62.1 |
| Pour point (° C.) | | −7.5 | −15.0 | −10.0 | 0.0 | −5.0 |
| Cold filter plugging point (° C.) | | −9.0 | −18.0 | −8.0 | −1.0 | −6.0 |
| Slow-cooling cloud point (° C.) | | −8.0 | −17.0 | −7.0 | 0.0 | −6.0 |
| Ignitability test | | 88 | 94 | 104 | 98 | 100 |
| Cold flow property test | Vehicle A | A | S | A | B | B |
| | Vehicle B | A | S | A | B | B |
| Fuel efficiency test | | 98 | 97 | 100 | 103 | 94 |

Examples 3-4, Comparative Examples 4-6

For Examples 3-4 and Comparative Examples 4-6, gas oil compositions were prepared having the compositions and properties listed in Table 2. The gas oil compositions of Examples 3 and 4 were fuels obtained by hydrotreatment of wax and middle fractions obtained from natural gas by Fischer-Tropsch reaction. The gas oil composition of Comparative Example 4 was a fuel from crude oil produced by ordinary hydrorefining. The gas oil composition of Comparative Example 5 was a fuel obtained by hydrotreatment of a wax and middle fraction obtained from natural gas by Fischer-Tropsch reaction, but the degree of hydrotreatment was lower than for the gas oil compositions of Examples 3 and 4. The gas oil composition of Comparative Example 6 was a fuel obtained by further hydrotreatment of a fuel from crude oil produced by ordinary hydrorefining, with further treatment of lowering sulfur content and aromatic content.

The gas oil compositions of Examples 3-4 and Comparative Examples 4-6 were subjected to the following tests.

[Ignitability Test]

In order to confirm the cold ignitability, the cold white smoke was measured using a diesel automobile on a chassis dynamometer with controllable environmental temperature.

(Vehicle Specifications)

Engine type: Inter cooler-equipped supercharged serial 4-cylinder diesel

Cylinder capacity: 3 L

Compression ratio: 18.5

Maximum output: 125 kW/3400 rpm

Maximum torque: 350 Nm/2400 rpm

Conformity to regulations: Conformed to 1997 exhaust gas regulations

Mission: 4AT

Exhaust gas post-treatment apparatus: Oxidation catalyst

For a cold actual driving test, first the fuel system of a diesel automobile was flashed with the evaluation fuel (each gas oil composition) at room temperature. The flashing fuel was extracted, the main filter was replaced with a new one, and then a prescribed volume of evaluation fuel was loaded into the fuel tank (½ the volume of the fuel tank of the test vehicle). Next, the environmental temperature was rapidly cooled from room temperature to 10° C., and after holding at 10° C. for 1 hour, it was slowly cooled to 0° C. at a cooling rate of 1° C./h, the temperature was held at 0° C. for 1 hour, and a running test was initiated. Cases in which start-up could not be achieved even by twice repeating 10-second cranking at 30 second intervals were recorded as unmeasurable. When start-up was achieved, a procedure was repeated 5 times in which idling was continued for 30 seconds and followed by full stamping of the accelerator pedal for 5 seconds, and the volume of white smoke that occurred was measured using a transmission measuring device. The average value of 5 measurements was calculated for each gas oil composition and recorded as a relative value with respect to 100 as the average value for Comparative Example 6, to evaluate the ignitability. The results are shown in Table 2.

[Hot Start-up Test]

In order to evaluate the hot start-up performance for each gas oil composition, a hot start-up test was carried out in the following manner using the diesel engine-mounted vehicle described below on a chassis dynamometer with controllable environmental temperature and humidity. After supplying 15 L of test fuel to the vehicle, the engine was started up and kept idling. The environmental temperature was set to 25° C. to stabilize the test room temperature, and the engine was stopped upon stabilization of the outlet temperature of the fuel injection pump of the idling vehicle. After allowing the stopped engine to stand for 5 minutes it was restarted, and in cases where the engine restarted normally, the environmental temperature was raised to 30° C. and then to 35° C. and the previous test procedure was repeated. For this test, a judgment of "pass" (A) was assigned for normal starting and a judgment of "fail" (B) was assigned for failure to start. The results are shown in Table 2.

(Vehicle Specifications)

Maximum load: 4 t

Engine type: Serial 6-cylinder diesel

Engine cylinder capacity: 8.2 L

Fuel injection pump: High-pressure distributor

Conformity to regulations: Conformed to long-term exhaust gas regulations (Prefectural designations for low-polluting vehicles)

Exhaust gas post-treatment apparatus: Oxidation catalyst

[Rubber Swelling Test]

A soak test was carried out by the following procedure to confirm the effect on rubber members used in engine O-rings and the like. The object of evaluation was a rubber member made of nitrile rubber (medium nitrile rubber), wherein the center value for the weight of bonded acrylonitrile, a constituent compound of the rubber, was between 25% and 35% of the total, and the test sample was heated to and kept at 100° C., after which the test rubber member was soaked therein for 70 hours, according to MIL R6855. The change in volume of the test rubber member after 70 hours was measured, and the durability of the rubber member was evaluated. The results are shown in Table 2. A mark of "A" in the column "Rubber swelling test" in Table 1 indicates that the changes in volume, hardness and tensile strength before and after the test were within ±10%, a mark of "B" indicates that they were from ±10% to ±20%, and a mark of "C" indicates that they were ±20% or greater.

[Fuel Efficiency Test]

The fuel efficiency was measured using the diesel engine-mounted vehicle described below. The test was carried out in transient driving mode to simulate actual running as shown in FIG. 2, and the fuel efficiency was determined with fuel temperature compensation of the volume flow of fuel consumed in the test mode and substitution of the value for the weight, comparing and quantifying each of the results relative to 100 as the result for testing of the fuel of Comparative Example 4. The results are shown in Table 2.

(Vehicle Specifications)

Engine type: Inter cooler-equipped supercharged serial 4-cylinder diesel

Engine cylinder capacity: 3 L

Compression ratio: 18.5

Maximum output: 125 kW/3400 rpm

Maximum torque: 350 Nm/2400 rpm

Conformity to regulations: Conformed to 1997 exhaust gas regulations

Mission: 4AT

Exhaust gas post-treatment apparatus: Oxidation catalyst

TABLE 2

| | | Example 3 | Example 4 | Comp. Ex. 4 | Comp. Ex. 5 | Comp. Ex. 6 |
|---|---|---|---|---|---|---|
| $\sum_{n=10}^{24} f(n)$ | | 387.6 | 384.9 | 364.2 | 352.7 | 382.2 |
| Sulfur content (ppm by mass) | | <1 | <1 | 5 | <1 | <1 |
| Aromatic content (% by volume) | | <0.1 | <0.1 | 18.0 | <0.1 | <0.1 |
| Naphthene content (% by volume) | | <0.1 | <0.1 | 31.4 | <0.1 | 53.2 |
| Density at 15° C. (kg/m$^3$) | | 773 | 780 | 822 | 768 | 805 |
| Kinematic viscosity at 30° C. (mm$^2$/s) | | 2.9 | 3.7 | 3.4 | 2.3 | 2.8 |
| Distillation properties | 10% distillation temp. (° C.) | 205.0 | 248.5 | 215.5 | 183.5 | 190.5 |
| | 50% | 263.0 | 277.5 | 266.0 | 248.5 | 251.5 |

TABLE 2-continued

| | Example 3 | Example 4 | Comp. Ex. 4 | Comp. Ex. 5 | Comp. Ex. 6 |
|---|---|---|---|---|---|
| distillation temp. (° C.) | | | | | |
| 90% distillation temp. (° C.) | 309.0 | 314.5 | 325.0 | 314.0 | 316.0 |
| E250 (%) | 37.6 | 17.1 | 33.9 | 50.9 | 46.4 |
| Cetane number | 81 | 85 | 63 | 74 | 64 |
| Cetane index | 84.5 | 89.4 | 58.3 | 79.8 | 60.8 |
| Pour point (° C.) | −5.0 | −5.0 | −10.0 | −5.0 | −10.0 |
| Cold filter plugging point (° C.) | −5.0 | −2.0 | −6.0 | −4.0 | −8.0 |
| Slow-cooling cloud point (° C.) | −4.0 | 0.0 | −4.0 | −3.0 | −6.0 |
| Ignitability test | 86 | 84 | 106 | 92 | 100 |
| Hot start-up test | A | A | B | B | B |
| Rubber swelling test | A | A | A | C | B |
| Fuel efficiency test | 97 | 95 | 100 | 105 | 94 |

The invention claimed is:

1. A gas oil composition comprising:

a C10-24 paraffin composition that satisfies the condition represented by the following inequality (1-1), a slow-cooling cloud point of no higher than −6.0° C. and a pour point of no higher than −7.5° C.,

[Mathematical Formula 1]

$$340.0 \leq \sum_{n=10}^{24} f(n) \leq 400.0 \quad (1\text{-}1)$$

wherein n represents the carbon number of the paraffin, and f(n) represents the paraffin composition parameter for the carbon number of n represented by the following formula (2):

[Mathematical Formula 2]

$$f(n)=27.45-3.55(b/a)-0.65(c/a) \quad (2)$$

wherein n represents an integer of 10-24 and a, b and c respectively represent the proportion of normal paraffins with carbon number of n in terms of molar value, of isoparaffins with carbon number of n and one branch and of isoparaffins with carbon number of n and two or more branches, with respect to the total amount of paraffins with carbon number of n, wherein the 10% distillation temperature of the gas oil composition is from 165° C. to 205° C., the 50% distillation temperature of the as oil composition is from 200° C. to 255° C., and the 90% distillation temperature of the gas oil composition is from 265° C. to 330° C.

2. A gas oil composition according to claim 1, wherein the cetane number is at least 65, the sulfur content is no greater than 10 ppm by mass, the aromatic content is no greater than 1% by mass, the naphthene content is no greater than 5% by mass and the cold filter plugging point is no higher than −5° C., and wherein the C10-24 paraffin composition that satisfies the condition represented by the following inequality (1-3),

[Mathematical Formula 5]

$$375.0 \leq \sum_{n=10}^{24} f(n) \leq 400.0. \quad (1\text{-}3)$$

3. A gas oil composition comprising:

a C10-24 paraffin composition that satisfies the condition represented by the following inequality (1-2), a distillate volume at a distillation temperature of 250° C., represented by E250, of 5-45% and a slow-cooling cloud point of higher than −6.0° C.,

[Mathematical Formula 3]

$$370.0 \leq \sum_{n=10}^{24} f(n) \leq 430.0 \quad (1\text{-}2)$$

wherein n represents the carbon number of the paraffin, and f(n) represents the paraffin composition parameter for the carbon number of n represented by the following formula (2):

[Mathematical Formula 4]

$$f(n)=27.45-3.55(b/a)-0.65(c/a) \quad (2)$$

wherein n represents an integer of 10-24 and a, b and c respectively represent the proportion of normal paraffins with carbon number of n in terms of molar value, of isoparaffins with carbon number of n and one branch and of isoparaffins with carbon number of n and two or more branches, with respect to the total amount of paraffins with carbon number of n, wherein the 10% distillation temperature of the gas oil composition is from 175° C. to 270° C., the 50% distillation temperature of the gas oil composition is from 230° C. to 300° C., and the 90% distillation temperature of the gas oil composition is from 285° C. to 330° C.

4. A gas oil composition according to claim 3, wherein the cetane number is at least 65, the sulfur content is no greater than 10 ppm by mass, the aromatic content is no greater than 1% by mass, the naphthene content is no greater than 5% by mass and the cold filter plugging point is no higher than −5° C.

* * * * *